United States Patent [19]

Millen

[11] 4,408,193

[45] Oct. 4, 1983

[54] WAVE RESPONSIVE SWIMMING POOL ALARM

[75] Inventor: Theodore I. Millen, Don Mills, Canada

[73] Assignee: Georgian Manufacturing Ltd., Don Mills, Canada

[21] Appl. No.: 271,774

[22] Filed: Jun. 8, 1981

[51] Int. Cl.[3] ..... G08B 21/00

[52] U.S. Cl. ..... 340/566; 340/573; 340/693

[58] Field of Search ..... 340/566, 573, 540, 527, 340/309.1, 693

[56] References Cited

U.S. PATENT DOCUMENTS

| | | | |
|---|---|---|---|
| 3,475,746 | 10/1969 | Nelson et al. | 340/566 |
| 3,636,544 | 1/1972 | Codina | 340/566 |
| 3,778,803 | 12/1973 | Jahn | 340/566 |
| 3,953,843 | 4/1976 | Codina | 340/566 |
| 4,203,097 | 5/1980 | Manning | 340/566 |
| 4,282,518 | 8/1981 | Bonner | 340/566 |

*Primary Examiner*—Glen R. Swann, III

[57] ABSTRACT

A wave detector for use in a swimming pool includes an electrical circuit provided with an alert member and a power source for operating the alert member. The circuit is normally open between two spaced apart electrodes which substantially eliminates all power drain from the source. When the electrodes are closed by the waves in the pool, the alert member is activated with the circuit further being provided with a normally conductive control member which changes to a nonconductive state for opening the circuit to deactivate the alert member which automatically returns to the conductive state to reset the circuit for further activation of the alert member.

17 Claims, 6 Drawing Figures

FIG. 1.
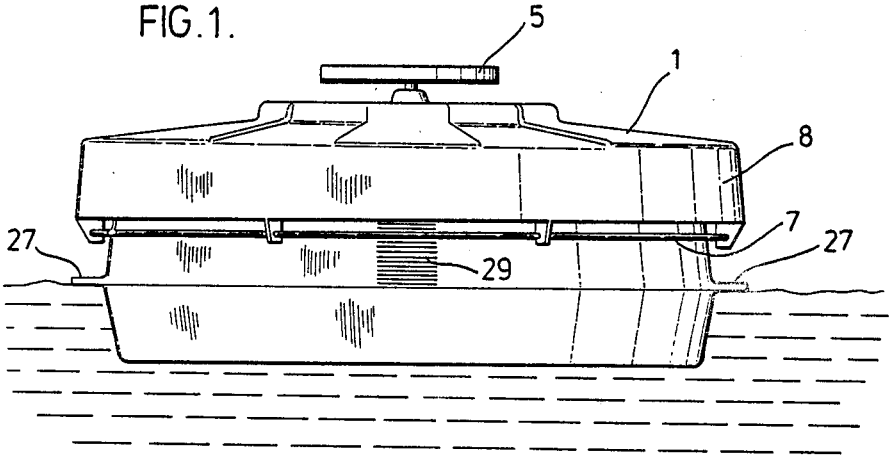
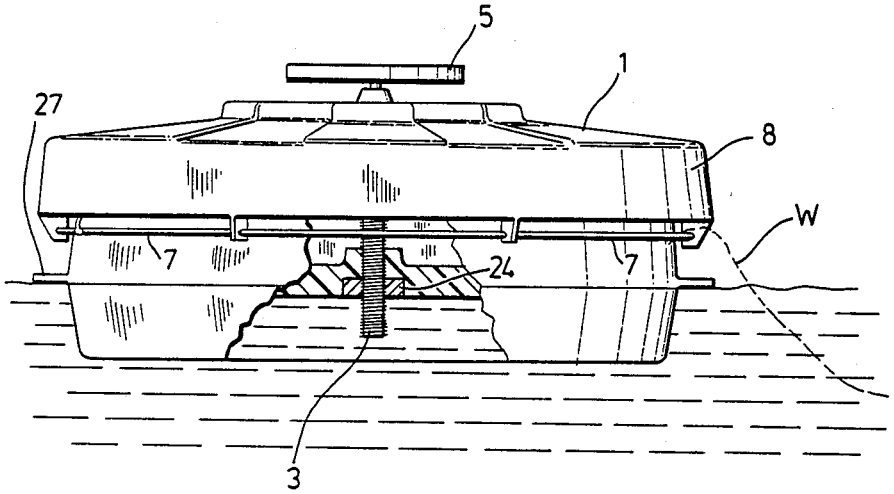
FIG. 2.

WAVE RESPONSIVE SWIMMING POOL ALARM

FIELD OF THE INVENTION

The present invention relates to a device for sensing specified conditions in a fluid medium and has particular application as a swimming pool alert for use in sensing wave patterns such as those generated by a person falling into the pool.

BACKGROUND OF THE INVENTION

There are a number of different applications for sensing devices capable of sensing specified conditions in fluid mediums which indicate a situation to be detected. One such device is a water safety warning apparatus examples of which are described in U.S. Pat. No. 3,636,544, issued Jan. 18, 1972 to George Jorge Codina, and U.S. Pat. No. 3,953,843, issued Apr. 27, 1976 also to George Codina. Another such device is the standard smoke detector.

As a practical matter, these sensing devices should be simple and efficient in operation. In addition, as is particularly true with the swimming pool alert, they may be subject to substantial abuse so that they should also be extremely durable. Furthermore it is important that these devices be inexpensive to operate and relatively maintenance free.

From a mechanical standpoint both of the Codina structures mentioned above have several drawbacks. They both include exposed components which in normal usage are susceptible of damage to the components without which the structures are inoperable. The unbalanced electrode design of the Codina structures reduces their efficiency in wave detection from all directions as is necessary to ensure maximum safety. As a further drawback, the Codina structures use a transmitter and a totally separate receiver for sounding the alarm increasing the number of pieces required to make the system work, the complexity of the circuits in the system and the likelihood of malfunctions.

From an electrical standpoint the Codina structure as well as other known water detecting devices, sound an alert which can only be shut down by either turning the device off or if left unattended, by allowing the power supply to completely drain. In the case where the alarm is manually shut off, it is often easy to forget to manually turn the device on again for later use. The draining down of the batteries can on the other hand occur if the device is inadvertantly activated without anyone being present to notice the alert. Furthermore, proper testing must be done to determine whether or not the device is still operative and without such testing one might rely upon the device without realizing that it is no longer operational.

SUMMARY OF THE PRESENT INVENTION

The present invention relates to a device for sensing a specified condition in a fluid medium. The device comprises a body portion and an electrical circuit carried by the body portion. The electrical circuit is provided with alert means, and a power source for operating the alert means. The circuit is normally open to substantially eliminate all power drain from the source and is adapted for closure by the specified condition to activate the alert means. The circuit is additionally provided with means for opening the circuit which is normally in a conductive state and which is changeable to a nonconductive state to deactivate the alert means.

However, the means for opening the circuit is adapted to automatically return to the conductive state such that the circuit is reset for further activation of the alert means.

Since the circuit is normally open there is no constant drain on the power source. Furthermore, the means for opening the circuit to deactivate the alert means in a manner such that the circuit is automatically reset ensures that the device cannot inadvertantly be switched off without switching the device on again.

According to an aspect of the invention, the body portion is buoyant enabling the device to be used in a swimming pool for sensing wave patterns typical of those generated by a person falling into the pool. The circuit includes two spaced apart electrodes the lower one of which is submerged in the water with the other electrode positioned above the water level of the pool. The alert means is actuated as the wave contacts the upper electrode which extends around the body portion to close the circuit at the electrodes regardless of the direction of approach of the wave. The upper electrode is adjustable in height relative to the water level to set the device for sensing waves of appropriate magnitude.

In order to conserve the power source after the alert is actuated the device includes both a timed bypass and reset in the circuit to automatically shut the circuit down after a predetermined time assuming the condition has cleared and a manual spring loaded shut-off which when released automatically closes the circuit to reset the alarm.

BRIEF DESCRIPTION OF THE DRAWINGS

The above as well as other advantages and features of the present invention will be described according to the detailed description of the preferred embodiments of the present invention wherein;

FIG. 1 is a side view of a wave detecting device according to a preferred embodiment of the present invention;

FIG. 2 is a view similar to FIG. 1 showing a partial section of the float portion of the wave detecting device;

DETAILED DESCRIPTION ACCORDING TO THE PREFERRED EMBODIMENTS OF THE PRESENT INVENTION

The device shown in FIGS. 1 through 4 is adapted to detect wave patterns typical of those generated by a person falling into a swimming pool or the like. As will be described in more detail, the device operates on the principle that a first electrode on the device is submerged in the water while a second electrode on the device is spaced above the water level in the pool. When a wave of sufficient amplitude is generated in the pool it acts as a contact between the two electrodes closing the electrical circuit in the device to sound an alert.

Figure 3:
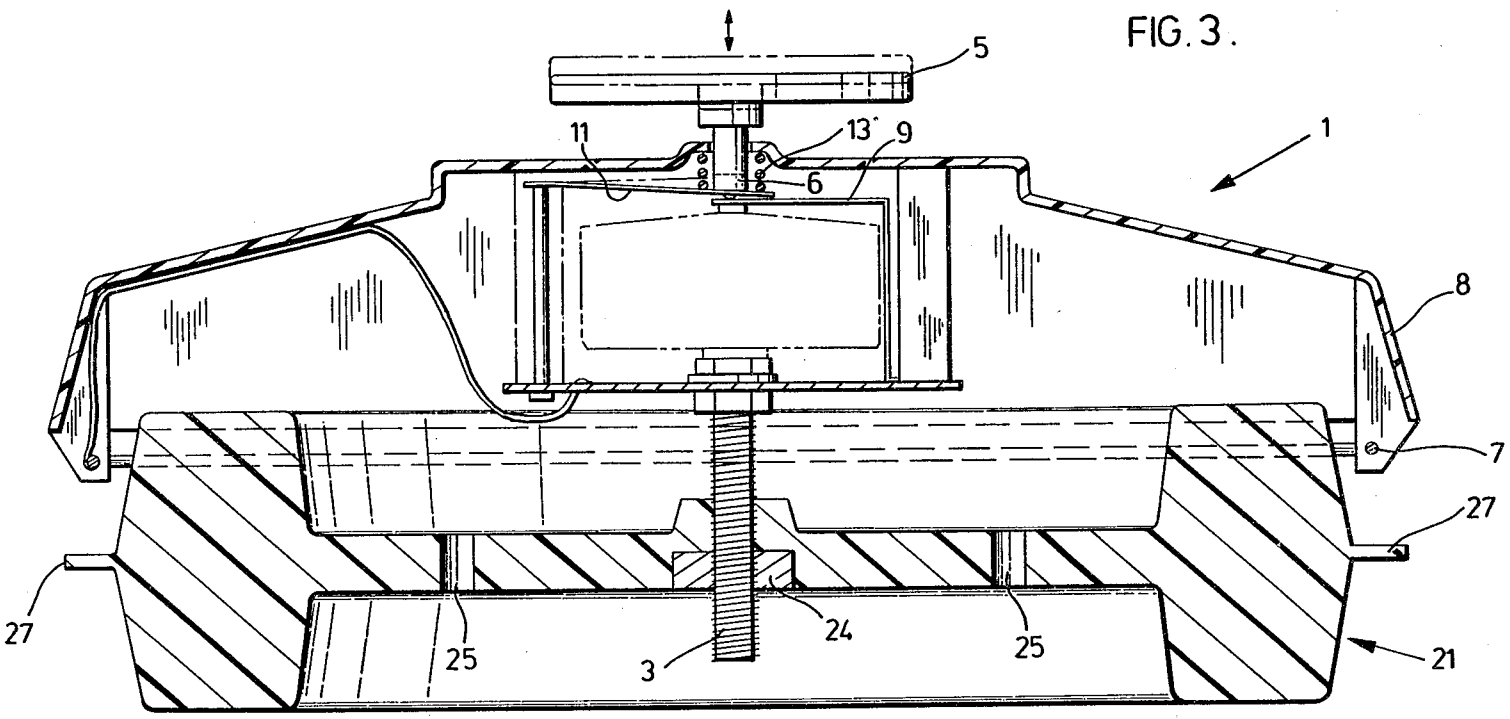
FIG. 3 is a cross-section of the device shown in FIG. 1.
Figure 4:
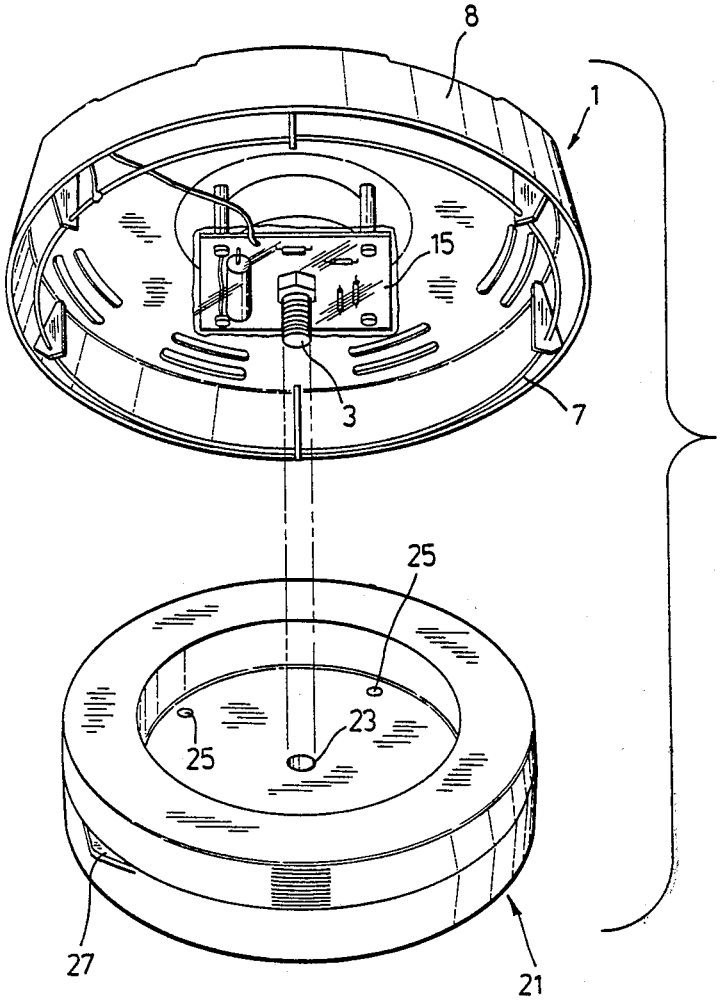
FIG. 4 is an exploded perspective view of the device shown in FIG. 1.

More specifically, as well shown in FIG. 3, the body portion of the device includes an upper circuit carrying portion generally indicated at 1 and a lower buoyant float portion shown at 21. These two portions are separable from one another as can be seen in FIG. 4. The electrical circuit is carried within the upper portion of an encapsulated circuit board 15 with the electrical components of the circuit sealed in a manner to prevent water damage to the circuit.

In the embodiment shown in the drawings, both of the electrodes are carried on the upper portion of the device. The first electrode is in the form of an elongated conductive threaded connector 3 which is fitted through a slightly undersized aperture 23 to a conductive threaded insert 24 of the lower float portion. The threaded connection between the two body portions permits relative height adjustment of the upper portion with respect to the lower portion. The undersizing of aperture 23 provides a friction fit along connector 3 to hold the connector from inadvertantly turning in the threaded nut and to maintain all adjustments.

According to the FIG. 2 position, the lower end of the threaded connector 3 penetrates completely through the lower body portion where it is submerged beneath the water surface. However because the threaded nut is also conductive the connector need not extend into the water as the nut then acts as the end of the electrode. Furthermore, if any air bubbles were trapped in the nut they would not effect the circuit because of the metal to metal contact between the submerged nut and the connector. The second electrode which is spaced away from the first electrode and above the normal surface level of the water is in the form of a metallic ring 7. This ring extends completely around the body portion so that it is effective regardless of the direction of approach of a wave at the device.

FIG. 1 shows the device in non-turbulent water conditions where the circuit is open between the two electrodes and the ring electrode 7 is out of contact with the non-turbulent surface level of the water. FIG. 2 however shows a turbulent water condition typical of that created by a person falling into the water generating a wave W. This generated wave closes the gap between the ring electrode 7 and the surface of the water by either hitting the electrode directly or by tilting the device to force the downside of the continuous electrode remote from the wave into the water to close the circuit between electrode 7 and electrode 3 which is located beneath the water surface. The alert means provided in the circuit then sets off an audible alert to warn of the situation.

In order to adjust the height of ring electrode 7 so that the device reacts to waves of predetermined amplitude and not simply to small ripples caused by the wind etc. the upper body portion is threadably adjustable in height with respect to the lower float portion. The lower float portion is provided on its outer surface with a scale 29 as an indication of the degree of adjustment. As will be appreciated because the ring electrode extends completely around the device, only one adjustment is necessary for the entire ring and that one adjustment has a uniform effect on the ring electrode around the device.

Referring again to FIG. 3, the lower float portion 21 is provided with a plurality of openings 25 to allow trapped water and air to escape through the float portion enabling the device to float at the proper level in the water. The lower float portion is further provided with tethering members 27 to tether the device at a specific location in the pool so that the device is maintained within easy reach and it does not get trapped in a corner or at the steps in the pool.

In order to ease placement of the unit into the pool the device is provided with a handle cut off switch arrangement which is centrally positioned on the device so that it does not effect the balance and which automatically resets itself when released. This arrangement comprises a spring loaded handle 5 moveable between an upper circuit opening and a lower circuit closing position. The handle is provided with a lower extension 6 secured atop a flexible contact 11. The handle and the flexible contact are normally biased downwardly by a spring 13 into an electrically contacting position with a second electrical contact 9. However, the pressure on spring 13 is less than the weight of the wave detecting device so that when the device is lifted by handle 5, flexible contact 11 is pulled upwardly away from contact 9 breaking the electrical circuit. This allows the device to be placed in the pool with the circuit being open so that should there be an inadvertant closing between electrodes 3 and 7 the alarm will not be sounded. After the device has been properly placed in the water, handle 5 is released whereby spring 13 forces contact 11 downwardly against contact 9 to once again close the electrical circuit.

As a further precaution against the electrical circuit being inadvertantly closed across the two spaced apart electrodes, a peripheral skirt 8 is provided above the ring electrode 7. This peripheral skirt prevents any water spouts such as those which might occur during a heavy rain fall from closing the gap between the water surface and the ring electrode. It also guards the ring electrode so that it is not exposed to damage outwardly of the body of the device.

The electrical circuit provided within the device is one which is adapted to sound an alarm for only a relatively brief period in terms of battery life but of more than adequate duration to draw attention to the alarm after which the circuit automatically shuts itself off if the condition has cleared. This feature is particularly desirable in the event that if the device is inadvertantly activated without anyone being present there are no excessive drains on the power source in the circuit.

Figure 5:
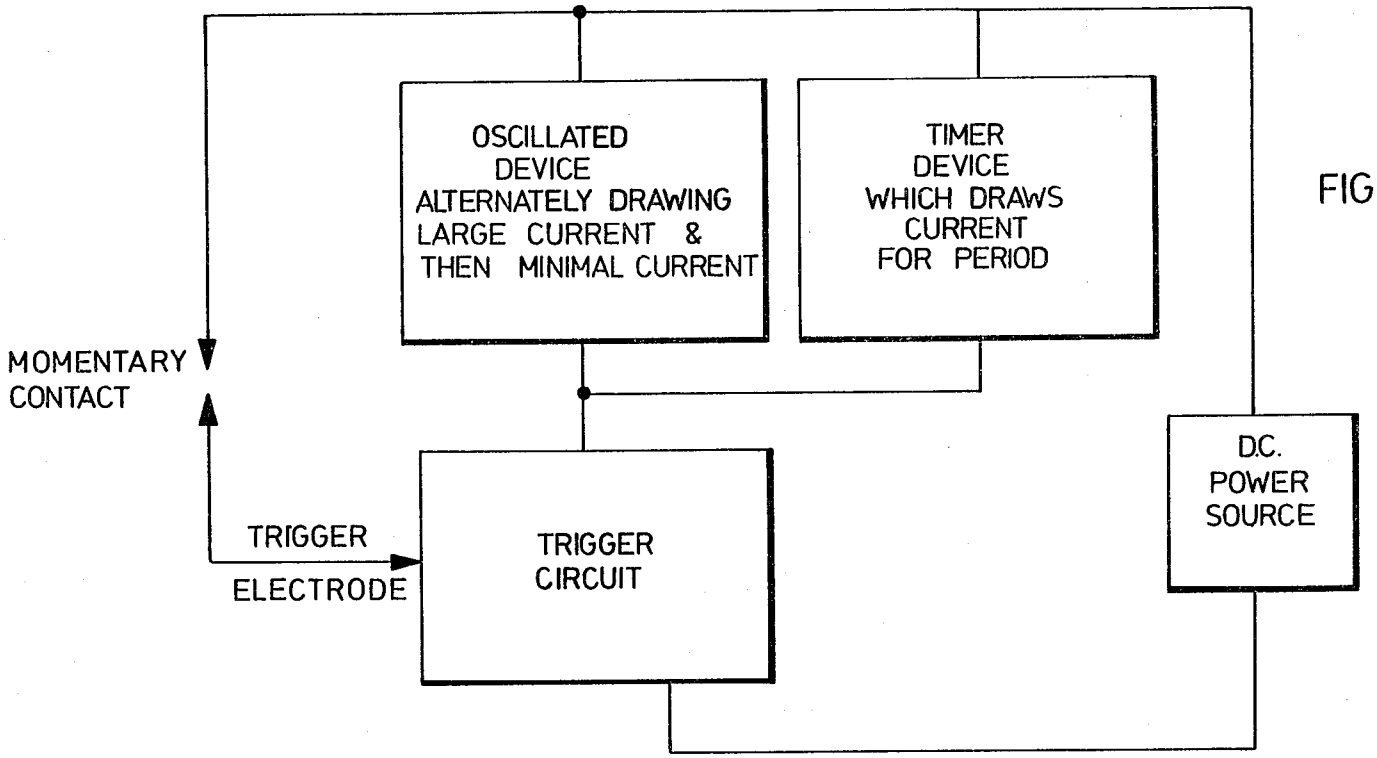
FIG. 5 is a block diagram of a circuit arrangement used in the device shown in FIGS. 1 through 4; and, FIG. 6 is a preferred circuit arrangement for use in the scheme of FIG. 5.

The circuit generally shown in FIG. 5 comprises a direct current power source, an oscillating device which alternatively draws large current and then minimal current from the circuit to provide an alarm, a trigger circuit for triggering on the circuit and a timer device which draws current for a period after which the circuit automatically shuts down.

Figure 6:
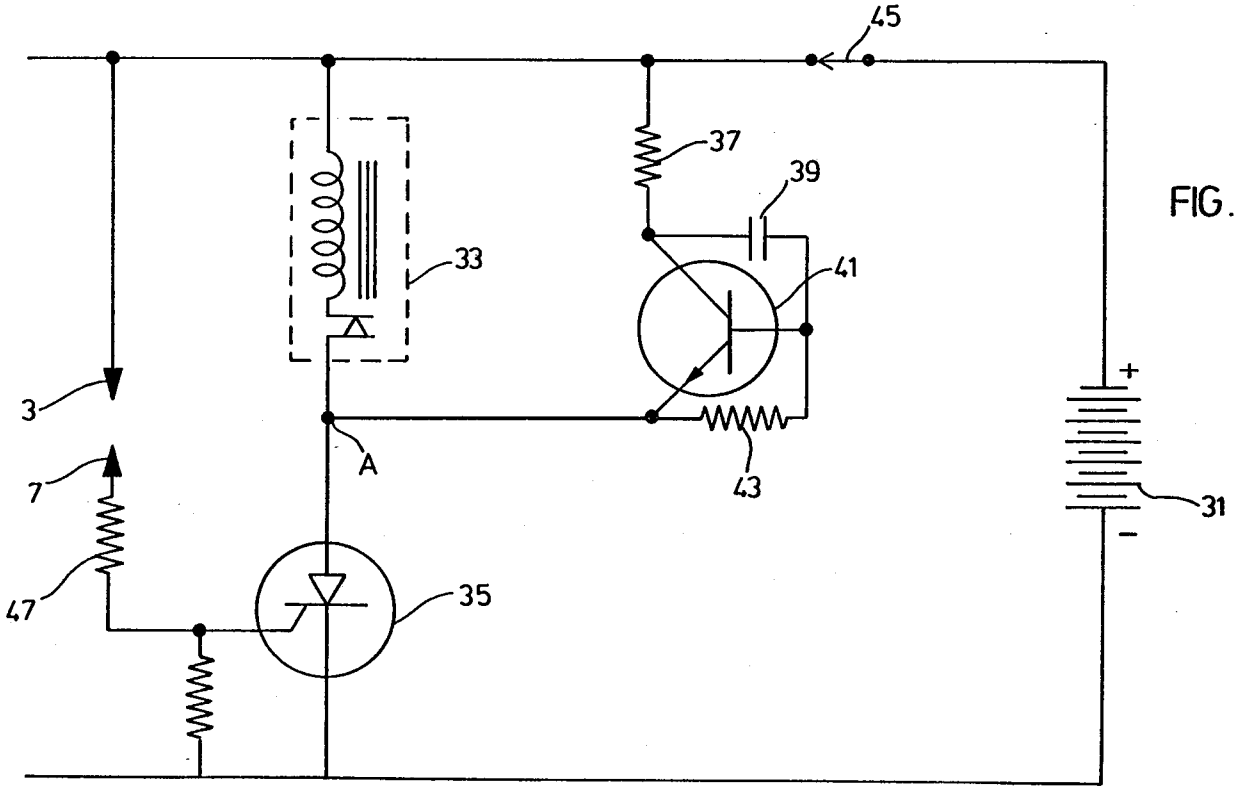

A more specific circuit arrangement is shown in FIG. 6. This circuit comprises a battery 31, an on/off vibrator buzzer 33, a silicon controlled rectifier or S.C.R. 35, a current limiting resistor 47, a trigger contact between electrodes 3 and 7 and a reset switch 45. The circuit further includes a "Miller run-down" circuit in the form of resistor 37, condenser 39, NPN transistor 41 and resistor 43.

When the trigger contact is made the silicon controlled rectifier triggers on, moving point A from the battery voltage to a lower voltage of about 1 volt. This causes the NPN transistor to conduct as condenser 39 applies a positive voltage to the base of the transistor in relation to its emitter. The oscillating buzzer operates for a time determined by the values of condenser 39 and resistor 43 and the amplification factor of the transistor.

Without the Miller circuit the S.C.R. would immediately trigger off with one cycle of the buzzer during which the buzzer opens. However the S.C.R. is maintained triggered by the branch current flowing through the Miller circuit during the charge-up time of the condenser. After the condensor has charged up the branch circuit current drops to a value lower than the hold-on current for the S.C.R. and the buzzer stops the circuit.

For automatic reset point A goes to battery voltage and the condensor discharges through resistors 37 and 43 reseting itself for another cycle.

During operation of the alarm the transistor amplifies the time for condensor charge-up. However in reset the transistor is not amplifying so that the condensor discharges much more quickly to its full reset condition. The alarm continues to sound as long as the condition exists regardless of the timer and will cease when the condition is removed providing the time has timed out. If the timer has not timed out the alarm will continue until the timer does so and the condition has cleared.

It will be appreciated that the circuitry described above can easily be adapted for use in smoke detectors and the like. According to either application, the circuitry is extremely effective in that it only senses certain conditions when those conditions exist and does not draw any current from the battery source at times when the conditions do not exist. Furthermore, after the sensed conditions have disappeared the circuit automatically shuts down to further increase life of the battery. The circuit does however automatically reset itself so that it is ready to sense further specified conditions in the particular fluid medium in which the device is used.

Although various preferred embodiments of the invention have been described herein in detail it will be appreciated by those skilled in the art that variations may be made thereto without departing from the spirit of the invention or the scope of the appended claims.

The embodiments of the invention in which an exclusive property or privilege is claimed are defined as follows:

1. A device for sensing waves of predetermined magnitude in a swimming pool and the like, said device comprising a body portion and an electrical circuit provided with alert means and power source for said alert means carried by said body portion, said circuit including first electrode which, when said device is in use, is in electrical contact with the water, and a second ring electrode mounted to and extending around said body portion and positioned normally out of the water above said first electrode for closure therewith by the waves of predetermined magnitude regardless of the direction of approach of the waves, said body portion comprising an upper body section on which said ring electrode is monted and a lower buoyant body section for floating of said device, said upper body section being adjustable relative to said lower body section to adjust height setting of said ring electrode relative to the water level and sensitivity of said device, said electrical circuit normally being open to substantially eliminate all power drain from said source when said circuit is open and being provided with conductive means in said circuit which is in a conductive state to enable operation of said alert means and which is changeable to a nonconductive state for opening the circuit to deactivate said alert means and which is automatically returned to the conductive state such that said circuit is automatically reset for further activation of said alert means and including timing means for changing said conductive means to the nonconductive state.

2. A device as claimed in claim 1 wherein said body sections are threadably secured to one another for ease of adjustment.

3. A device as claimed in claim 2 wherein said first electrode includes a threaded connector between said body sections.

4. A device as claimed in claim 3 including a handle for carrying said device, said handle comprising a manual circuit control spring member biased to close said electrical circuit and manually moveable to break said electrical circuit, the spring bias on said handle being less than the weight of the device such that said electrical circuit is automatically broken by lifting said device by said handle.

5. A device as claimed in claim 2 wherein said first electrode comprises a threaded connector and nut combination between said body sections.

6. A device as claimed in claim 3 or 5 wherein said threaded connector is frictionally engaged in said body portion to resist inadvertant threading between said body sections.

7. A device as claimed in claim 2 wherein said ring extends at an essentially constant level such that adjustment of said upper body section uniformly adjusts the height of said ring.

8. A device as claimed in claim 1 including a spring-loaded manual circuit control member normally biased to close said circuit and manually moveable to break said circuit.

9. A device as claimed in claim 8 wherein said manual circuit control member comprises a handle for carrying said device, the spring bias on said handle being less than the weight of said device such that said circuit is automatically broken by lifting the device by said handle.

10. A device as claimed in claim 9 wherein said handle is located centrally of said device for balancing thereof.

11. A device as claimed in claim 2 or 9 wherein said power source comprises a portable battery, said alert means comprises an oscillating audible alert member which alternately draws large current and then minimal current, said electrical circuit including a branch control circuit including a condensor, a transistor for amplifying chargeup current of said condensor, a first resistor in advance of said condensor and a second resistor between the base and the emitter of said transistor and an SCR for triggering said electrical circuit; said oscillating audible alert member being activated whenever said first and second electrodes are in electrical contact with one another and said oscillating audible alert member being automatically deactivated after a period timed by said branch control circuit and reset for further activation after said electrical circuit is broken at said electrodes.

12. A device as claimed in claim 1 wherein said circuit comprises said power source which is direct current, said alert means alternately drawing large current and then minimal current therethrough, a timerr which draws current for a specified period, and a trigger circuit for activating said alert means, the arrangement being such that said alert means is activated whenever said first and second electrodes are in electrical contact with one another and said alert means is automatically deactivated by said timing means and reset for further activation after the circuit is broken at said first and second electrodes.

13. A device as claimed in claim 12 wherein said trigger circuit comprises a silicon controlled rectifier.

14. A device as claimed in claim 12 wherein said alert member comprises an oscillating audible alert member.

15. A device as claimed in claim 12 wherein said timer comprises a branch control circuit including a condensor, a transistor for amplifying charge up of said condensor, a first resistor in advance of said condensor and a second resistor between the base and the emitter of said transistor.

16. A device as claimed in claim 1 including a switch comprising a spring loaded handle normally biased to close said circuit and manually moveable to break said circuit, the spring load on said handle moving the handle back to close the circuit when released.

17. A device as claimed in claim 16 wherein the spring load on the handle is less than the weight of the device such that the circuit is broken by lifting the device by said handle.

* * * * *